US007832802B2

(12) United States Patent
Ehlers et al.

(10) Patent No.: US 7,832,802 B2
(45) Date of Patent: Nov. 16, 2010

(54) TRAVEL HEAD SUPPORT

(76) Inventors: Jill Annette Ehlers, 4728 Rising Glen Dr., Central Point, OR (US) 97502; Kenneth Edwin Ehlers, 4728 Rising Glen Dr., Central Point, OR (US) 97502

( * ) Notice: Subject to any disclaimer, the term of this patent is extended or adjusted under 35 U.S.C. 154(b) by 307 days.

(21) Appl. No.: 12/077,701

(22) Filed: Mar. 20, 2008

(65) Prior Publication Data

US 2009/0236893 A1 Sep. 24, 2009

(51) Int. Cl.
*A47C 7/38* (2006.01)

(52) U.S. Cl. ..... 297/393

(58) Field of Classification Search ..... 297/391, 297/393, 397

See application file for complete search history.

(56) References Cited

U.S. PATENT DOCUMENTS

| | | | | | |
|---|---|---|---|---|---|
| 4,339,151 | A | | 7/1982 | Riggs | |
| 4,560,201 | A | * | 12/1985 | Scott | 297/393 |
| 4,707,031 | A | * | 11/1987 | Meistrell | 297/393 |
| 5,073,989 | A | | 12/1991 | Teague | |
| 5,081,714 | A | | 1/1992 | Liu | |
| 5,378,042 | A | | 1/1995 | Daneshvar | |
| 5,395,158 | A | | 3/1995 | Cordia | |
| 5,505,523 | A | | 4/1996 | Wang | |
| 5,974,607 | A | * | 11/1999 | Smith | 297/393 |
| 6,209,959 | B1 | | 4/2001 | Meye | |
| 6,266,825 | B1 | | 7/2001 | Floyd | |
| 6,301,716 | B1 | * | 10/2001 | Ross | 297/393 |
| 6,607,245 | B1 | | 8/2003 | Scher | |
| 6,799,802 | B1 | | 10/2004 | Moran | |
| 6,805,403 | B2 | | 10/2004 | Buch | |
| 6,859,965 | B1 | * | 3/2005 | Gourd | 297/393 |
| 7,004,545 | B2 | | 2/2006 | Miller | |
| D534,389 | S | | 1/2007 | Chisholm et al. | |
| 7,246,853 | B2 | | 7/2007 | Harcourt et al. | |
| 7,547,071 | B2 | * | 6/2009 | Huffman | 297/397 |
| 2004/0124685 | A1 | | 7/2004 | Buch | |
| 2005/0268377 | A1 | | 12/2005 | Massey | |
| 2006/0061186 | A1 | * | 3/2006 | Funke et al. | 297/393 |

* cited by examiner

*Primary Examiner*—Peter R. Brown
(74) *Attorney, Agent, or Firm*—Antonio Papageorgiou; Ostrow Kaufmann LLP

(57) ABSTRACT

A travel head support is made up of a headband partially encircling the head, the headband having free ends and an adjustable strap between the ends for extension around the headrest portion of a seat, and a frontal portion includes a pocket for insertion of hot or cold packs or aromatic oils. In another embodiment, a head support can be releasably attached to headwear, so as to permit the head support to remain on a passenger's head whether or not the head support is attached to a headrest.

5 Claims, 7 Drawing Sheets

TRAVEL HEAD SUPPORT

The following relates to head supports; and more particularly relates to different embodiments of travel head supports which are conformable for use alone or in combination with other headwear.

BACKGROUND AND FIELD

Numerous types of head support devices have been devised in the past which are adapted to be adjustably wrapped around a user's head and are provided with a retention band or strap that can be releasably secured to the upright portion of a seat, such as, for example, a headrest in order to restrain the user's head from bending forwardly or sideways when the user is napping or sleeping. Devices of the type described are especially useful for automobile or airline passengers in order to relieve stress or strain on the neck muscles if the head is permitted to incline forwardly or sideways over extended periods of time and which can often result in extremely sore or strained muscles, commonly referred to as a "stiff neck."

Notwithstanding the number of head supports which have been developed in the past and the closeness of the prior art, there is a continuing need for a headband which affords maximum adjustability for different head sizes as well as for different types of upper back and headrests, particularly as encountered in different makes of automobile and airline seats. Moreover, there is a continuing need for a head support which is soft, comfortable, compact, can be easily stored and is adaptable for use alone or in combination with other headwear; and wherein the device allows the user to add extra padding, instant heat/cold compresses for comfort or for headaches, or essential oils which aid sleep and which may be contained in small packets that can be slipped into the head support along the forehead region of the user.

SUMMARY

It is therefore desirable to provide for one or more embodiments of a novel and improved head support which will facilitate adjustable support of the head of a user with respect to the upper back or headrest portion of a seat and which is readily conformable for use on airplane seats, car seats, train seats, RV seats, and children's car seats, as well as strollers, enabling the user to rest or sleep in an upright or slightly reclined position.

Further, it is desirable to provide different embodiments of a travel head support which can be worn alone or used with other headwear, such as, for example, baseball-style or beanie/ski cap-style headwear. Moreover, it is desirable to provide such a device which is soft, comfortable, compact, and easily stored, for instance, in a carry-on bag; and further wherein the device can be easily placed on the head and installed over the back of a seat and which has limited elasticity or stretchability to conform to the head size of the user as well as to permit limited movement of the head when the head support is secured to a head or back rest. In this relation, it is desirable that the elastic is strong enough to hold the head up comfortably without falling forward or side-to-side.

In one embodiment, the head support is characterized by having a stretchable headband at least partially encircling the person's head at forehead or eye level, the band terminating in free ends and including an adjustable strap between said terminal ends for extension around the upper back or headrest portion; and a frictional surface portion on the strap is engageable with a back surface of the upper back or headrest portion. The headband is further characterized by having an outer sleeve portion of soft material and an inner elastic strap portion within the sleeve, and a non-elastic extension of the strap portion from one of the terminal ends of the band is adjustably secured to the other terminal end of the band in fitting the headband onto the head portion at the desired level.

In another embodiment which incorporates the essential features of the one embodiment described, the headband includes a frontal portion encircling opposite sides and forehead of the person's head with a pocket formed in the sleeve portion which enables removable insertion of various sleeping aids, such as, but not limited to, hot or cold packs and aromatic oils. In still another embodiment, the device includes means for releasable attachment to the lower edge of headwear, such as, to the inner band of a baseball cap which will permit the head support to remain in place along with the headwear whether or not the head support is attached to a headrest portion.

The above and other advantages and features of the embodiments described will become more readily appreciated and understood from a consideration of the following detailed description of the embodiments when taken together with the accompanying drawings, in which:

DETAILED DESCRIPTION OF A FIRST EMBODIMENT

Figure 1:
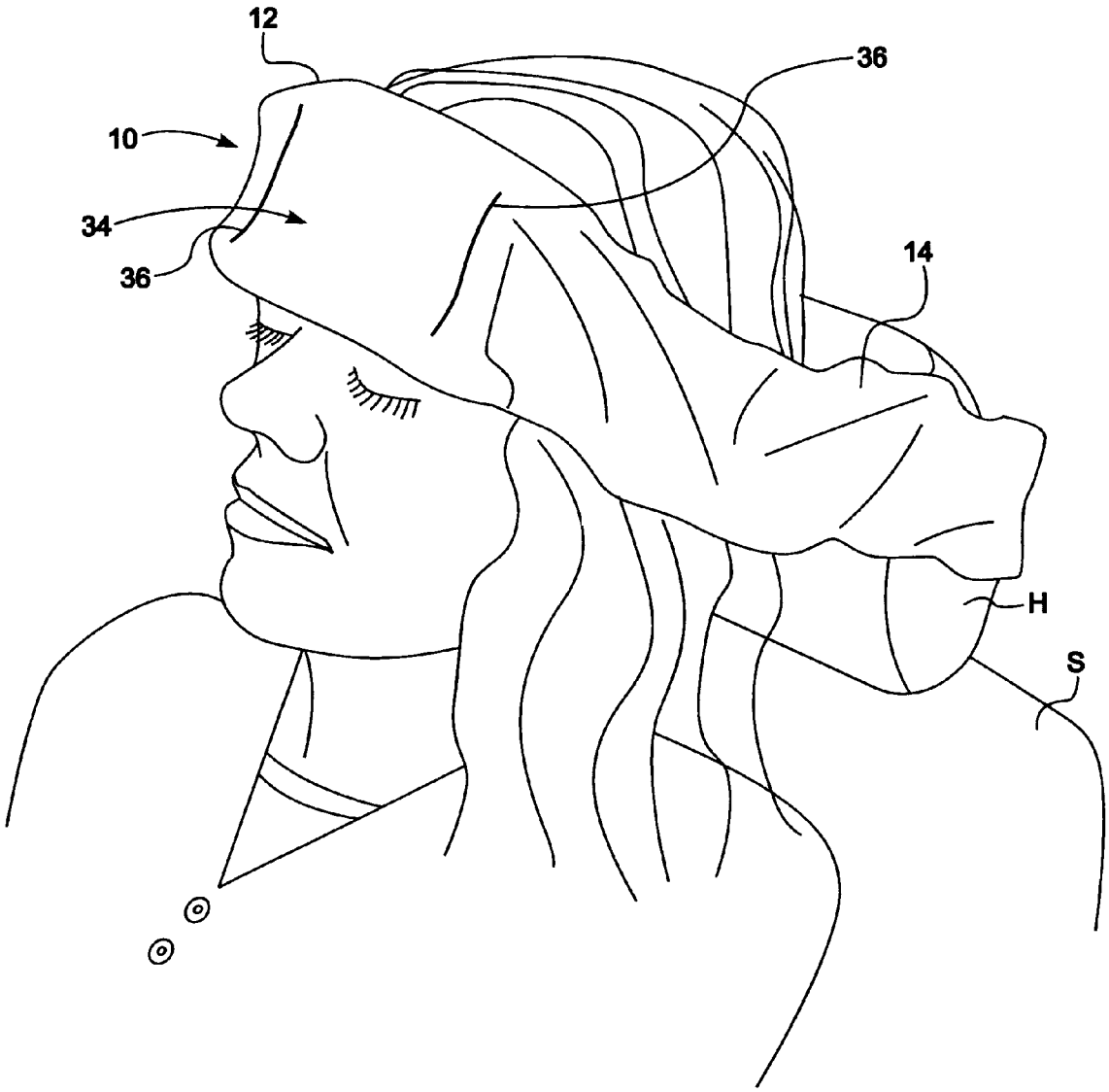
FIG. 1 is a perspective view of a first embodiment of a head support at least partially encircling the head of a user when seated.
Figure 2:
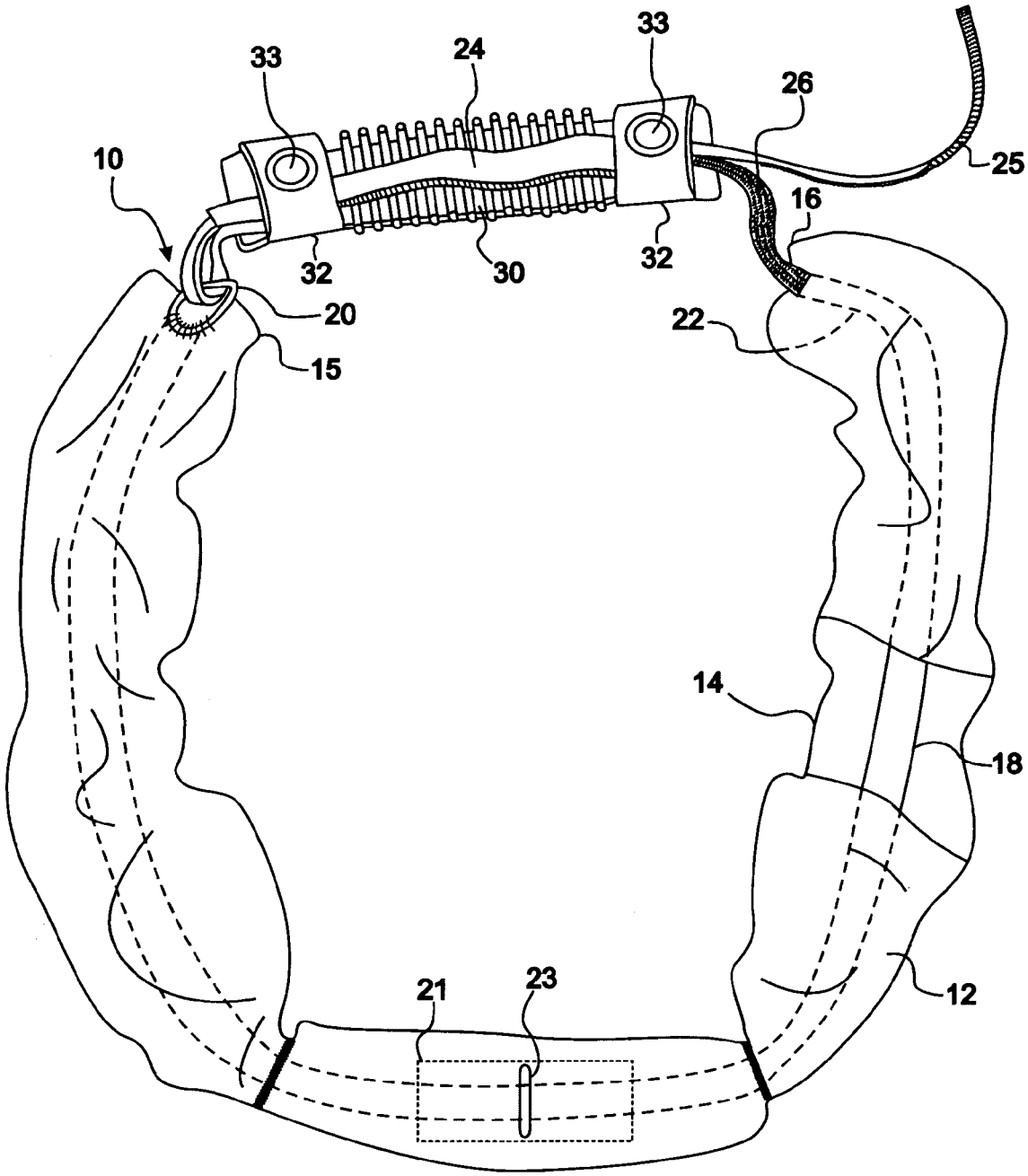
FIG. 2 is a top plan view of the head support when not attached to the user or headrest.
Figure 3:
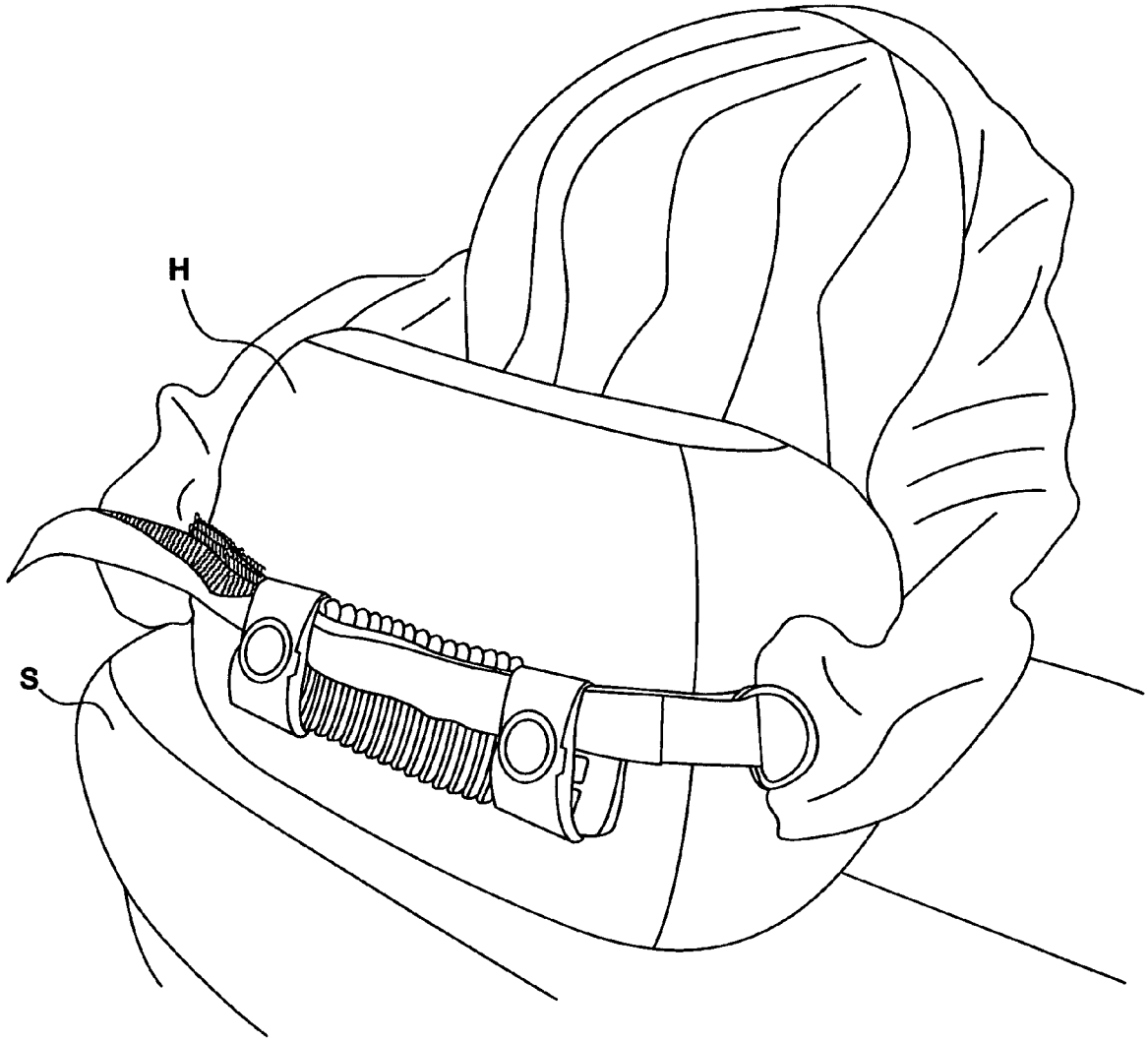
FIG. 3 is a somewhat perspective rear view illustrating the first embodiment attached to the back of a headrest.

Referring in detail to the drawings, there is illustrated in FIGS. 1 to 3 the first embodiment of a head support 10 which is broadly comprised of a headband 12 having an outer fabric sleeve 14 which is designed to at least partially encircle a person's upper head region and terminates in opposite free ends 15 and 16. An elastic strap 18 extends through the entire length of the band, one end of the strap having an O-ring or D-ring 20 permanently attached to the end 15 of the sleeve, and the opposite end 22 of the strap 18 is permanently affixed to the opposite end 16 of the band. A non-elastic extension strap 24 forms a continuation of the strap 18 from the one end 22 and is provided with hook-and-loop fastener surface portions 25 and 26, e.g., Velcro®, which are aligned on the strap 24 such that, when the free end portion of the extension strap 24 is passed through the D-ring 20, one of the hook-and-loop fastener portions 25 will be aligned and attached to the complementary fastener portion 26 on an intermediate portion of the strap 24 so that the user can loop the non-elastic extension strap 24 over a headrest H of a seat S and easily adjust it to maintain the head in an upright position. An important advantage in passing the headband 12 over the headrest H without a direct connection to the headrest H is that it can be easily positioned and removed when necessary to enable the user to turn or shift the head sideways without disconnecting the band. Another feature of the headband 12 is the utilization of a flexible collar 30 which is mounted on the strap 24 by looped ends 32 which are releasably snapped together as at 33 so that the collar is free to slide lengthwise of the strap 24 and make it easier for the head to turn or shift as described. In addition, the collar 30 may be composed of a rubber or rubber-like material with a frictional surface which will engage and grip the surface of the headrest H but the strap 24 is free to slide through the collar 30 to make it easier for the user's head to turn or shift with respect to the headrest H.

Still another feature of the first embodiment as described is that the headband 12 is made up of a soft fabric or fleece-like material that is capable of stretching with the elastic strap 14 at least to a limited extent to permit both forward and sideways shifting of the head over a limited distance. Furthermore, the band 12 includes a specially designed frontal portion 34 at its midsection which will be oriented or aligned with the front or forehead of the user and is provided with seams spaced apart lengthwise along the sleeve 18 to retain the elastic strap 14 in proper alignment. A rear pocket 21 is formed by a slit or button holes 23 along an interior of the frontal portion, as shown in FIG. 2, to accommodate removable insertion of various sleeping aids, such as, but not limited to, small packets of hot or cold compresses for comfort or for headaches, or packets of essential oils such as lavender which will aid sleep. The pocket also may be used for extra padding along the area of the forehead between the elastic strap 18 and sleeve 14. Finally, the band may also include advertising or any type of wording such as "Do Not Disturb" along the frontal portion 34.

In use, the composition of the materials making up the headband 12 enable folding into a compact bundle which can be stored in an extremely small compartment including but not limited to luggage, purse or carry-on bag. The head support can be pre-adjusted to the desired size by using a bucket-style car seat head rest at home before leaving on a trip and is readily conformable for use on airplane seats, car seats, train seats, RV seats, as well as children's car seats, thereby enabling the user to sleep in an upright or slightly reclined position. The compositions of the sleeve 14 and strap 18 as described are such that it will permit limited turning or shifting of the head as described but nevertheless are strong enough to hold the head up comfortably without falling forward or side-to-side and thus preventing neck strain. If the support 10 has to be adjusted, it can be taken off the seat S to permit adjustment of the Velcro® fasteners 25 and 26 on the strap 24 and then slipped back over the headrest H.

DETAILED DESCRIPTION OF SECOND EMBODIMENT

Figure 4:
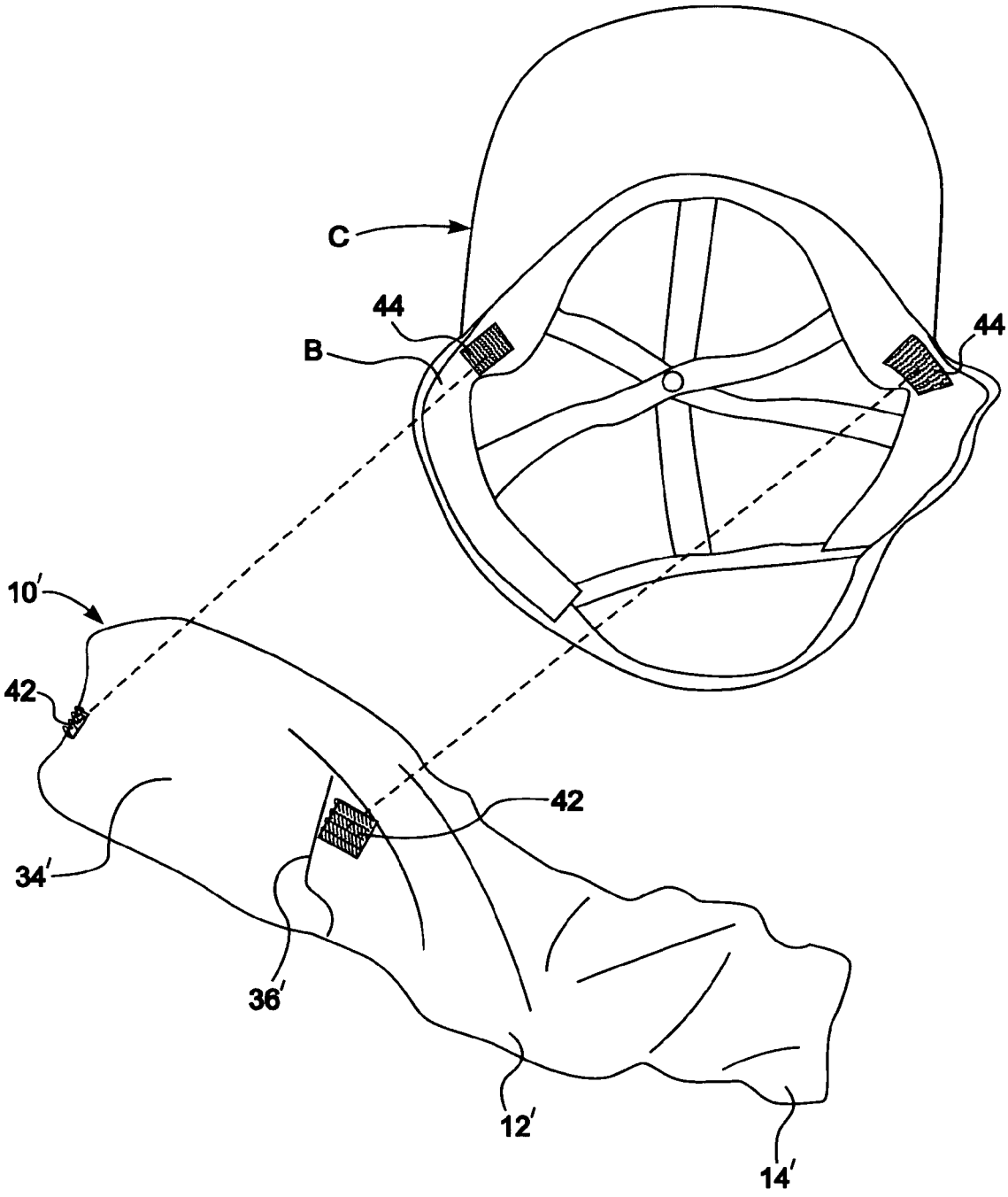
FIG. 4 is an exploded view of a modified embodiment of a head restraint when not attached to a user of headrest.
Figure 5:
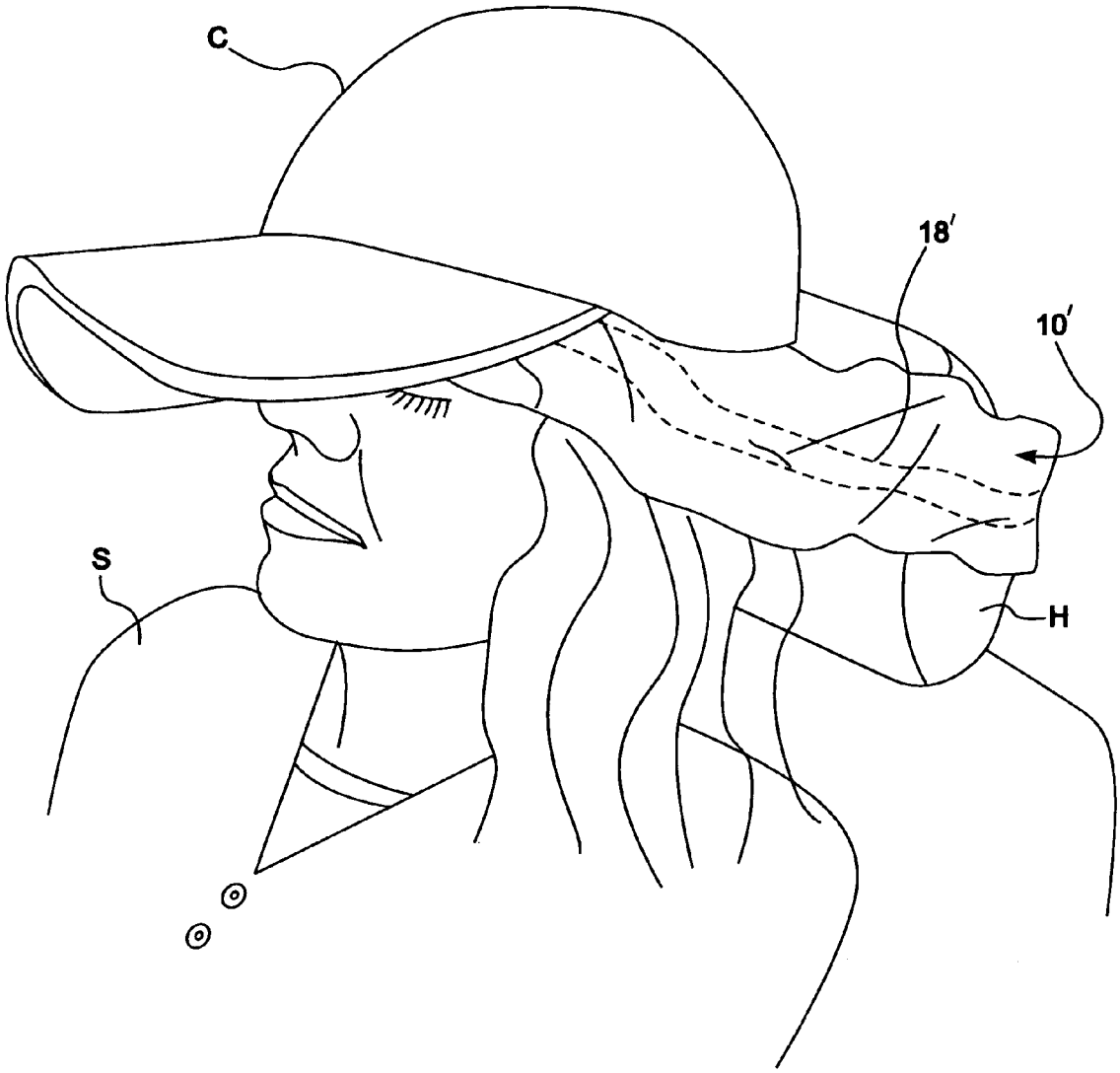
FIG. 5 is a perspective view showing the embodiment of FIG. 4 worn by a user.
Figure 6:
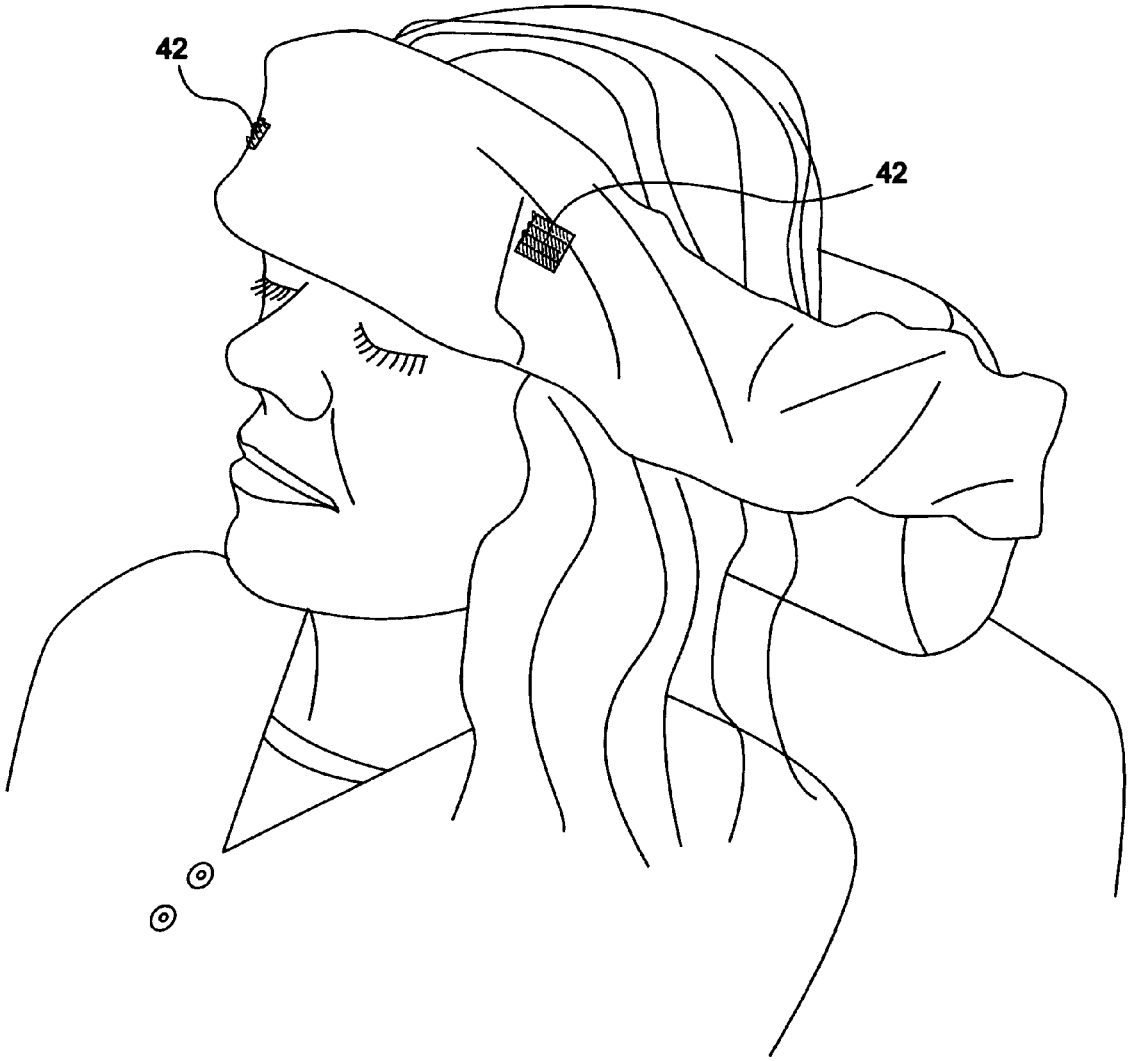
FIG. 6 is a view similar to FIG. 5 without the headwear.
Figure 7:
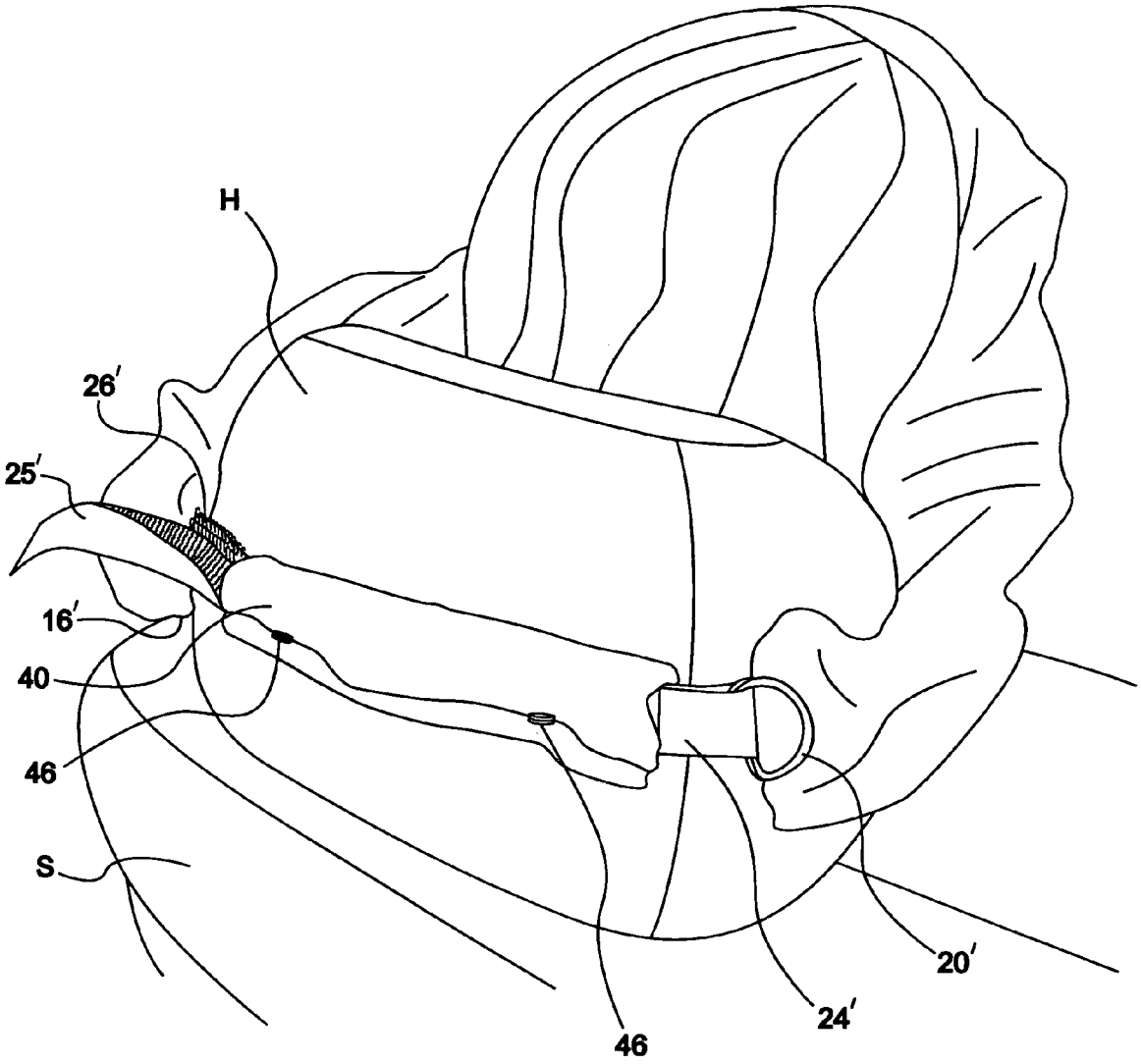
FIG. 7 is another perspective rear view showing the modified head support attached to the back of a headrest.

FIGS. 4 to 7 illustrate a second embodiment which utilizes the head support 10 of the first embodiment in combination with other headwear. Accordingly, like elements are correspondingly enumerated with prime numerals. Thus, the head support 10' is once again comprised of a headband 12' having sleeve 14' and an elastic strap 18' extending through the entire length of the sleeve 14'. Hook-and-loop fastener strips 25' and 26' are sewn together to form the non-elastic portion 24' which extends from one end 16' and the opposite free end of strap 24' is inserted through the D-ring 20' and looped back on itself and closed by aligning the hook half 25' of the fastener with the loop half 26'. In place of the collar 30, the adjustable strap portion 24' is inserted into a sleeve 40 which is made up of a fabric strip to which a thin coating of non-skid, machine-washable rug-like backing is applied to the outside, and snaps 46 at opposite ends of the strip 40 are snapped together to form a tube that will cover the strap 24' and provide the necessary grip to secure the band to a seatback or headrest H in the same manner as described in FIGS. 1 to 3. A shoulder strap pad, such as the one manufactured by Franzus Co., LLC of Beacon Falls, Conn., may also be used in the same capacity as the sleeve 40 above. The modified form of head device as described may be used alone or in combination with headwear by utilization of releasable fasteners between opposite sides of the sleeve 12' and inside band of a hat or cap C. For example, FIGS. 4 to 6 illustrate the utilization of hook-and-loop fasteners in which the hook half is in the form of a square or rectangular strip 42 and securely attached to the outer surface of the sleeve 14'; and the loop half is also in the form of a corresponding square or rectangular strip 44 affixed to the inner band B of the sports cap C, the sports cap being merely representative of various types and styles of headwear with which the head support device may be utilized.

When worn with the cap C, the frontal portion 34' of the head support can extend downwardly beneath the inner band B of the cap so as to permit placement either at the forehead level or over the eyes; and the adjustable strap 24' at the rear is covered with the cloth-like tubular portion. Again, as in the first embodiment, it is recommended that the strap 24' be adjusted in length so that it can be placed or looped over the back of a headrest H with the tubular portion 40 gripping the surface of the headrest with the desired degree of tautness to support the head against excessive movement.

Although a number of characteristics and advantages have been discussed above, those of ordinary skill in the art will recognize other modifications, permutations, additions, and sub-combinations thereof. It is therefore intended that the following appended claims and any claims hereafter introduced should be interpreted to include all such modifications, permutations, additions, and sub-combinations as are within their true spirit and scope.

We claim:

1. In a head restraint for a person sitting in a chair of the type provided with an upper back or headrest portion, the combination comprising:

a headband at least partially encircling the person's head at forehead level; and said band terminating in free ends and including an adjustable strap in between said ends for extension around said upper back or headrest portion; and a frictional surface portion engageable with a back surface of said upper back or headrest portion; the headband comprising:

an outer flexible fabric sleeve having a first free end and a second free end, and a O or D shaped ring attached to the first end;

an elastic strap fixed to the first free end of the fabric sleeve, extending through the fabric sleeve, and fixed to the second free end of the fabric sleeve;

a non-elastic extension strap having a hook fastener portion and a loop fastener portion, the extension strap continuing from the second free end of the fabric sleeve and looping through the O or D shaped ring attached to the first free end of the fabric sleeve such that at least a portion of one of the hook and the loop fastener portions pass through the O or D shaped ring; and a flexible collar, the frictional surface portion disposed on the flexible collar, the frictional surface comprising a rubber or rubber-like friction band disposed on at least one side of the flexible collar, the flexible collar having at least one loop, the extension strap passing through the loop while being free to slide lengthwise through the at least one loop.

2. The head restraint of claim 1, the outer flexible fabric sleeve having a pocket disposed on a frontal portion of the fabric sleeve to accommodate at least one of sleeping aids and hot or cold packs.

3. The head restraint of claim 1, wherein the frictional surface comprises a series of rubber or rubber-like friction bands disposed on at least one side of the flexible collar, the flexible collar comprising a loop on a first end, and a loop on a second end, each of the looped ends comprising a pair of opposing tabs releasably snapped together, the extension strap passing through the looped ends while being free to slide lengthwise through the looped ends.

4. The head restraint of claim 1, further comprising a cap wearable by the person, the cap attached to the fabric sleeve.

5. The head restraint of claim 4, wherein the cap is releaseably attached to the frontal portion of the fabric sleeve.

* * * * *